US011807434B2

(12) United States Patent
Berge

(10) Patent No.: US 11,807,434 B2
(45) Date of Patent: Nov. 7, 2023

(54) TWO-PIECE CAP

(71) Applicant: Silgan White Cap LLC, Downers Grove, IL (US)

(72) Inventor: Gary L. Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 17/590,452

(22) Filed: Feb. 1, 2022

(65) Prior Publication Data

US 2022/0153489 A1 May 19, 2022

Related U.S. Application Data

(63) Continuation of application No. 16/676,289, filed on Nov. 6, 2019, now Pat. No. 11,267,624.

(51) Int. Cl.
*B65D 51/18* (2006.01)
*B65D 41/34* (2006.01)

(52) U.S. Cl.
CPC ..... *B65D 51/18* (2013.01); *B65D 41/3428* (2013.01); *B65D 2251/0015* (2013.01); *B65D 2251/0078* (2013.01)

(58) Field of Classification Search
CPC ..... B65D 51/18; B65D 41/3428; B65D 2251/0015; B65D 2251/0078
USPC ..... 215/344
See application file for complete search history.

(56) References Cited

U.S. PATENT DOCUMENTS 3,249,248 A * 5/1966 Metzendorf ..... B65D 41/0492 215/334
3,517,847 A 6/1970 Guala
4,238,042 A * 12/1980 Hatakeyama ..... B65D 55/00 215/334
4,271,974 A * 6/1981 Quinard ..... B65D 51/18 215/331
5,863,145 A * 1/1999 Dumler ..... B65D 51/18 215/331
2005/0161425 A1* 7/2005 Morini ..... B65D 41/3428 215/220
2011/0024420 A1* 2/2011 King ..... B65D 51/18 220/254.8
2013/0221007 A1 8/2013 Jung et al.
2015/0210449 A1* 7/2015 Abegglen ..... B65D 51/20 53/421
2015/0251820 A1 9/2015 Glaser et al.
2015/0353241 A1 12/2015 Glaser et al.
2017/0225843 A1* 8/2017 Glaser ..... B65D 43/0277
(Continued)

*Primary Examiner* — J. Gregory Pickett
*Assistant Examiner* — Niki M Eloshway
(74) *Attorney, Agent, or Firm* — Reinhart Boerner Van Deuren s.c.

(57) ABSTRACT

A 2-piece closure includes a cap having a first skirt perpendicular to, and extending downwardly from, a first circular top wall. The first skirt includes a groove and a first anti-rotation formation. A tamper band attaches to the first skirt by frangible members. A cap cover includes a second skirt extending downwardly from a second circular top wall. The second circular top wall and the second skirt define an interior having a groove engagement formation and a second anti-rotation formation. The cap cover encloses a portion of the cap, with the groove engagement formation and the groove engaged. The first and second anti-rotation formations interact to restrict rotation of the cap cover relative to the cap.

20 Claims, 12 Drawing Sheets

(56) References Cited

U.S. PATENT DOCUMENTS

| | | | | |
|---|---|---|---|---|
| 2018/0093802 | A1* | 4/2018 | Paganuzzi | B65D 50/041 |
| 2020/0055647 | A1* | 2/2020 | Paganuzzi | B65D 41/3423 |
| 2020/0377280 | A1 | 12/2020 | Pace et al. | |
| 2021/0047085 | A1* | 2/2021 | Jin | A45D 40/00 |

* cited by examiner

TWO-PIECE CAP

CROSS-REFERENCE TO RELATED PATENT APPLICATION

This application is a continuation of U.S. application Ser. No. 16/676,289, filed Nov. 6, 2019, which is incorporated herein by reference in its entirety.

BACKGROUND OF THE INVENTION

The present disclosure relates generally to the field of closures for containers. The present disclosure relates specifically to a 2-piece closure for closing a container.

SUMMARY OF THE INVENTION

One embodiment of the invention relates to a 2-piece closure, for closing a container having a neck portion defining an opening to the container. The neck portion includes a mating sealing formation and a mating attachment formation. The closure includes a cap. The cap has a first circular top wall with a first diameter and a first skirt perpendicular to the first circular top wall. The first skirt extends downwardly from a periphery of the first circular top wall to a lower edge of the first skirt. The first skirt includes an inner surface. The inner surface has a sealing formation. An outer surface of the first skirt includes a groove at the periphery of the first circular top wall and at least a first anti-rotation formation formed on the outer surface. A tamper band is concentric with and attached to the lower edge of the first skirt by a plurality of frangible members. A cap cover includes a second circular top wall with a second diameter greater than the first diameter. A second skirt extends downwardly from a periphery of the second circular top wall. The second circular top wall and the second skirt define an interior having a groove engagement formation and at least a second anti-rotation formation formed therein. The cap cover encloses at least a portion of the cap when the groove engagement formation is engaged with the groove. The first and second anti-rotation formations interact to restrict rotation of the cap cover relative to the cap. When the 2-piece closure is applied to the neck portion of the container, the sealing formation of the cap engages the mating sealing formation of the neck portion of the container. In this configuration, the tamper band engages the mating attachment formation to seal the container. When the cap is removed from the neck portion, all the frangible members are broken, and the tamper band remains engaged with the mating attachment formation.

Another embodiment of the invention relates to a 2-piece closure, for closing a container having a neck portion defining an opening to the container. The neck portion includes at least one thread and an engagement ring. The closure includes a cap. The cap has a first circular top wall with a first diameter and a first skirt perpendicular to the first circular top wall. The first skirt extends downwardly from a periphery of the first circular top wall to a lower edge of the first skirt. The first skirt includes an inner surface. The inner surface has at least one engagement thread. An outer surface of the first skirt includes an attachment groove at the periphery of the first circular top wall, and a plurality of anti-rotation grooves formed perpendicular to the first circular top wall on the outer surface. A tamper band is concentric with and attached to the lower edge of the first skirt by a plurality of frangible members. A cap cover includes a second circular top wall with a second diameter greater than the first diameter. A second skirt extends downwardly from a periphery of the second circular top wall. The second circular top wall and the second skirt define an interior having a groove engagement formation and a plurality of fins formed therein perpendicular to the second circular top wall. The cap cover encloses at least a portion of the cap when the groove engagement formation is engaged with the attachment groove. The fins engage the anti-rotation grooves to restrict rotation of the cap cover relative to the cap. When the 2-piece closure is applied to the neck portion of the container, the engagement thread of the cap engages the at least one thread of the neck portion of the container. In this configuration, the tamper band engages the engagement ring to seal the container. When the cap is removed from the neck portion, all of the frangible members are broken, and the tamper band remains attached to the container by the engagement ring.

A further embodiment of the invention relates to a 2-piece closure, for closing a container having a neck portion defining an opening to the container. The neck portion includes at least one thread and an engagement ring. The closure includes a cap. The cap has a first circular top wall with a first diameter and a first skirt perpendicular to the first circular top wall. The first skirt extends downwardly from a periphery of the first circular top wall to a lower edge of the first skirt. The first skirt includes an inner surface. The inner surface has at least one engagement thread. An outer surface of the first skirt includes an attachment groove at the periphery of the first circular top wall, and a plurality of anti-rotation grooves formed perpendicular to the first circular top wall on the outer surface. The anti-rotation grooves are spaced evenly around a circumference of the first skirt. A tamper band is concentric with and attached to the lower edge of the first skirt by a plurality of frangible members. A cap cover includes a second circular top wall with a second diameter greater than the first diameter. A second skirt extends downwardly from a periphery of the second circular top wall. The second circular top wall and the second skirt define an interior having a groove engagement formation and a plurality of fins formed therein perpendicular to the second circular top wall. The cap cover encloses at least a portion of the cap when the groove engagement formation is engaged with the attachment groove. The fins engage the anti-rotation grooves to restrict rotation of the cap cover relative to the cap. When the 2-piece closure is applied to the neck portion of the container, the engagement thread of the cap engages the at least one thread of the neck portion of the container. In this configuration, the tamper band engages the engagement ring to seal the container. When the cap is removed from the neck portion, all of the frangible members are broken, and the tamper band remains attached to the container by the engagement ring.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

DETAILED DESCRIPTION

A two-piece lid or closure that has an over cap or cover and an insert or cap is described. The separation of the cover and cap into two components facilitates the manufacturing and design by separating the functions of the cover and cap from one another. In some embodiments, this configuration enables a variety of aesthetic designs to be applied to a standard cap size. The final product of joining the cover and cap appears as though only a single part (e.g., a single lid) is coupled to the container. This configuration enables the cap to hang or couple to different caps and/or containers as desired.

Moreover the functionality of the cap to seal the container and provide a tamper-evident drop band is enhanced by separating the functionality of this component from the aesthetics of the cover. The cap can be slit or molded with bridges or tethering to provide this functionality. The cover is then coupled to the cap, enabling multiple covers with substantially the same insert to couple to the same cap. As will be described in greater detail below, ribs on the cover engage with serrations on cap to rigidly couple the cover and cap. The rigidly coupled cover and cap form a lid or closure that that seals and rotates as a single piece. In some embodiments, the cover and cap include feature locks or inserts to further secure the feel of the closure as a single piece. This construction enables modification to either the aesthetics or functionality of the closure (e.g., the cover) without affecting the functionality of the cap.

Figure 1:
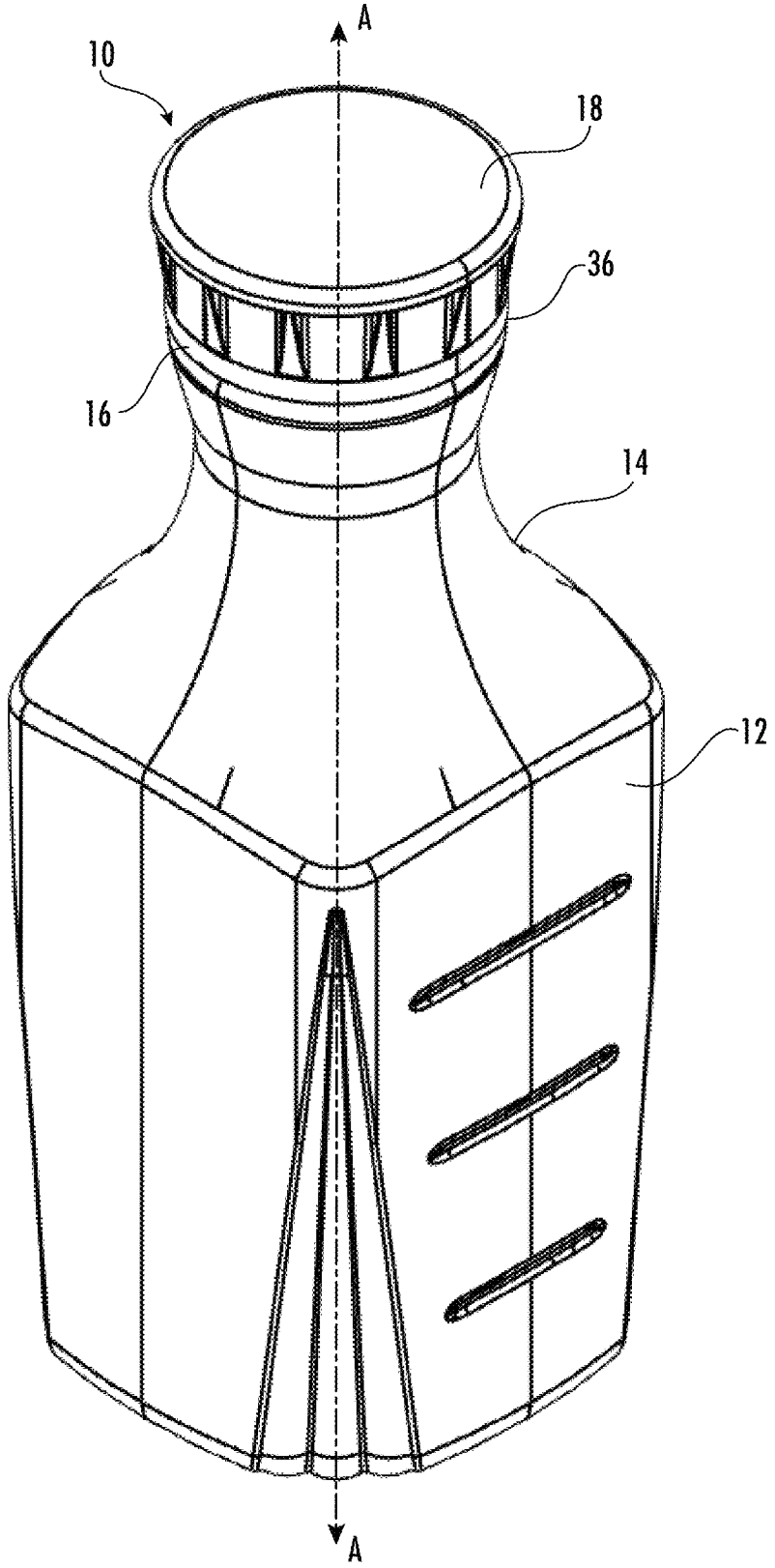
FIG. 1 is a perspective view of a closure on a container, according to an exemplary embodiment.
Figure 2:
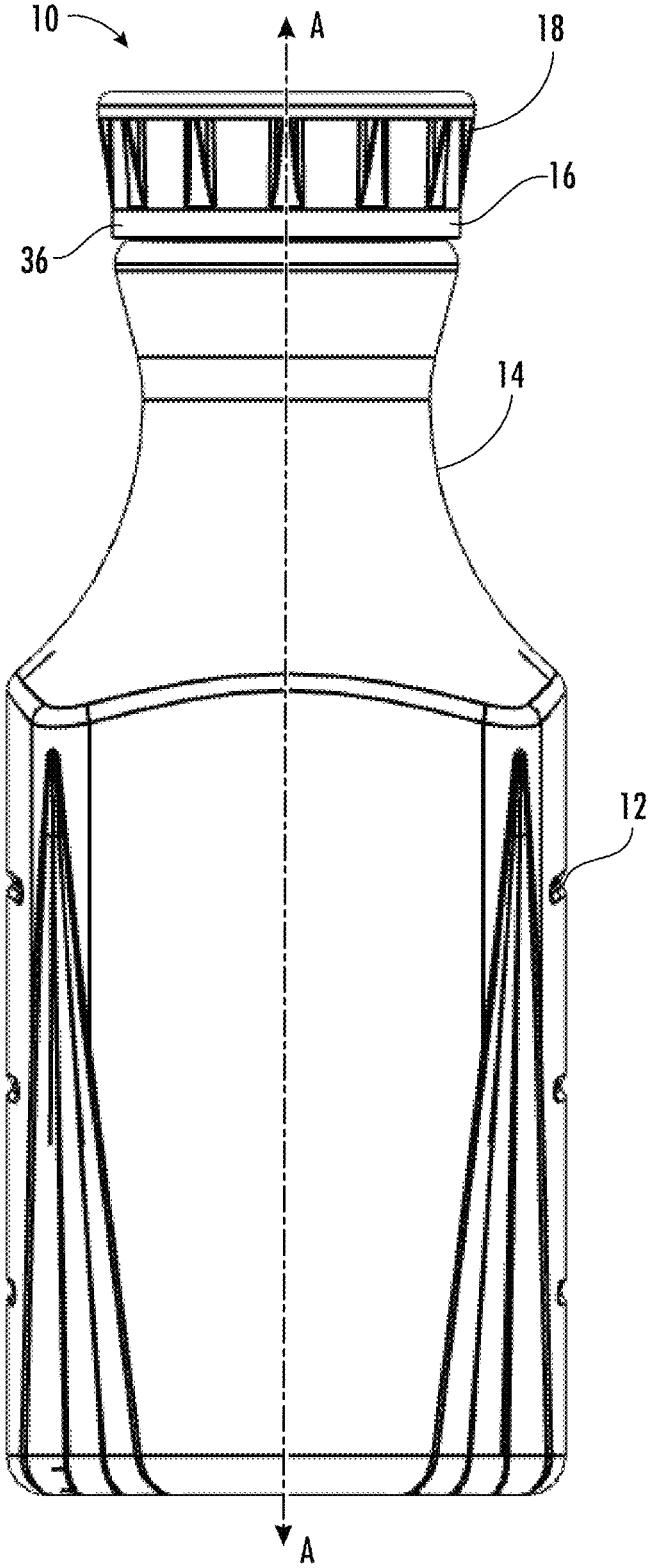
FIG. 2 is a side view of the closure on the container of FIG. 1, according to an exemplary embodiment.

FIGS. 1 and 2 show perspective and side views of a closure 10 coupled to a container 12. Closure 10 couples to a neck 14 of container 12 to close and/or seal container 12. Similarly, removal of closure 10 (e.g., rotating closure 10 off neck 14) exposes the internal volume of container 12 to the external environment. As will be described in detail below, closure 10 includes a cap 16 (FIG. 3) that fits within a cover 18 to form a 2-piece closure 10 that seals on neck 14 of container 12. In other words, cap 16 fits within cover 18 to form closure 10 (e.g., 2-piece closure 10 or a lid). As shown in FIGS. 1 and 2, only a small section of cap 16, e.g., a tamper band 36, remains visible when closure 10 is coupled to container 12.

Figure 3:
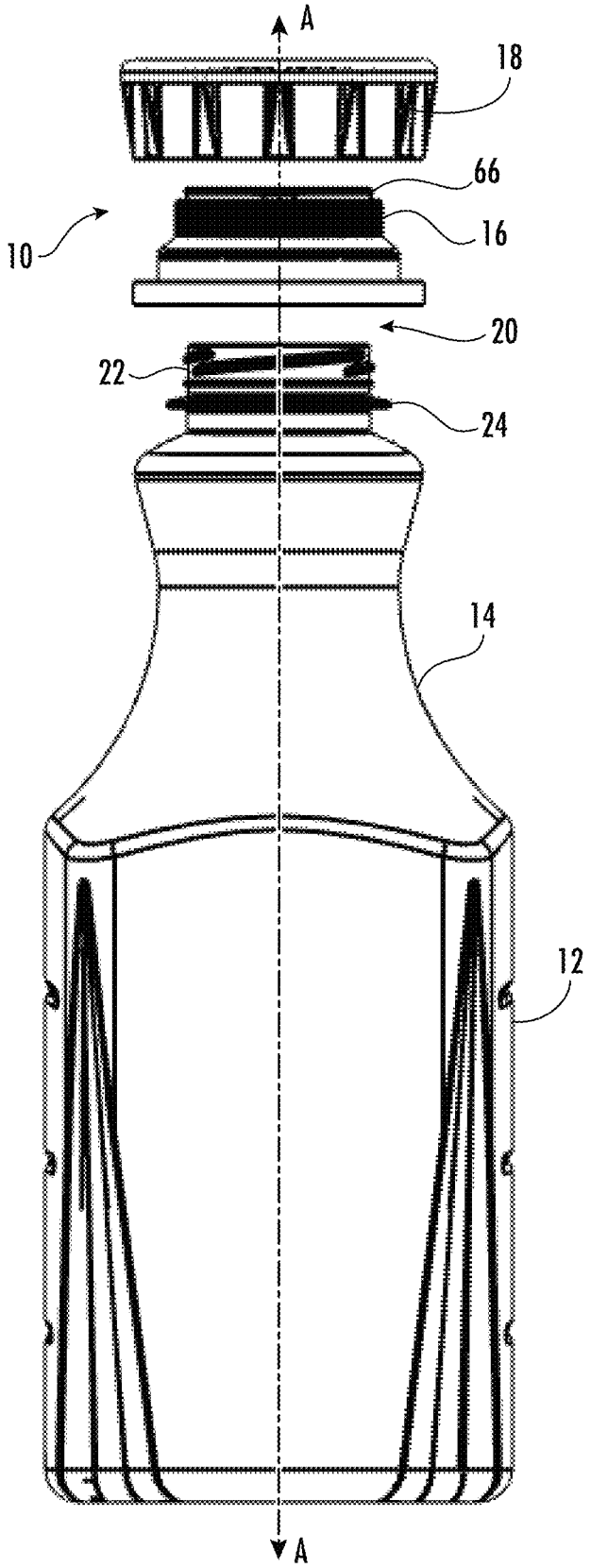
FIG. 3 is an exploded side view of the closure and the container of FIG. 1, according to an exemplary embodiment.

FIG. 3 shows an exploded side view of 2-piece closure 10 and container 12, according to an exemplary embodiment. FIGS. 1-3 show neck 14 as an elongate member of container 12 that extends along a longitudinal axis A-A. One end of neck 14 couples to container 12 and a second end, opposite the first end, defines an opening or aperture 20 in fluid communication with the internal cavity of container 12. In other words, neck 14 provides a passageway from an internal cavity of container 12 through aperture 20 and extending outwards to the external environment. Closure 10 couples to neck 14 to seal or close the passageway. As depicted in FIG. 3, neck 14 includes a mating sealing formation, or at least one thread 22 and a mating attachment formation, or engagement ring 24. In some embodiments, closure 10 and/or container 12 is molded from a polymer or plastic material, e.g., HDPE. In some embodiments, closure 10 is formed from injection molding. Exemplary materials for molding include, but are not limited to plastics, polymers, thermoset and/or thermoplastic materials.

Figure 4:
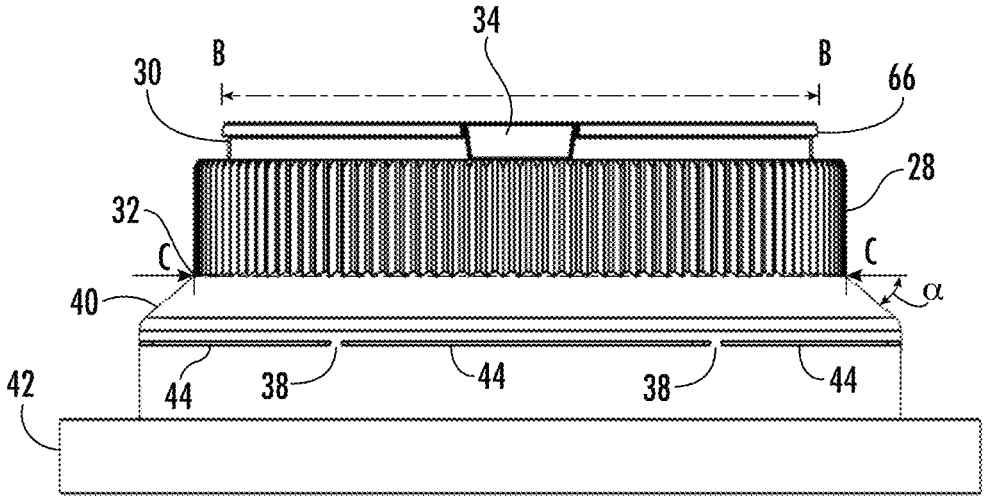
FIG. 4 is a side view of a cap of the closure of FIG. 3, according to an exemplary embodiment.
Figure 5:
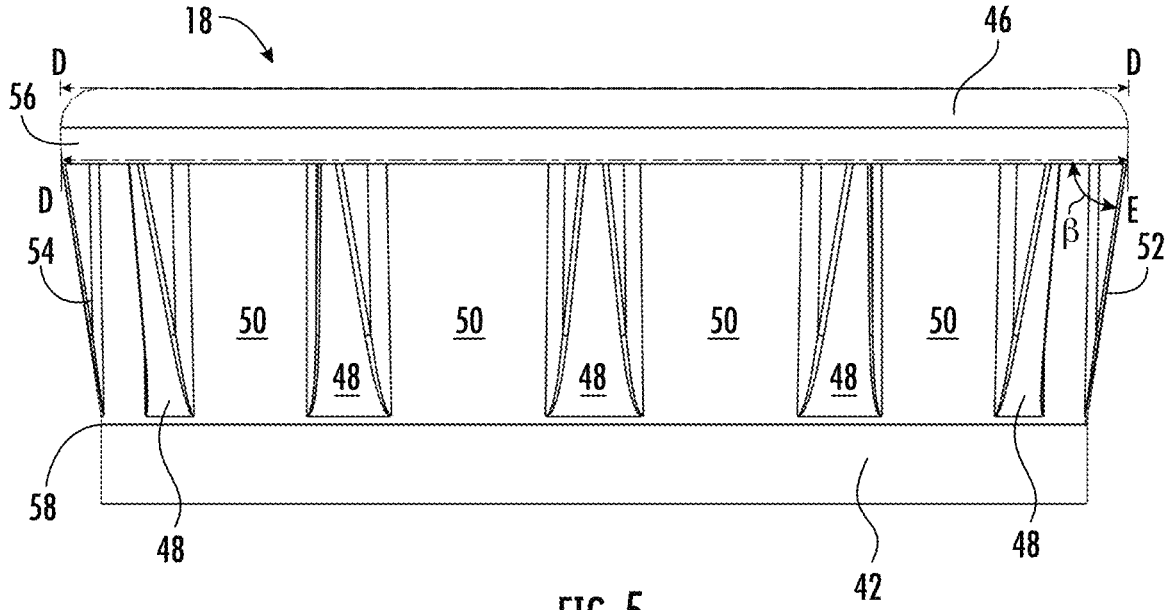
FIG. 5 is a side view of a cap cover of the closure of FIG. 3, according to an exemplary embodiment.

FIG. 4 shows a detailed view of cap 16, shown in FIG. 3. Closure 10 (FIGS. 1 and 2) is formed by coupling an insert or cap 16 to an over-cap or cover 18 (FIG. 5). Cap 16 includes a circular top wall 26, a cap skirt 28, and a tapered section 40 coupled to a tamper band 36 with a plurality of frangible members 38. In some embodiments, circular top wall 26 of cap 16 is circular with an external diameter B-B that defines a periphery 30 along the circular top wall 26. A cap skirt 28 extends perpendicular to (e.g., downward from) the periphery 30 of cap 16. Cap skirt 28 transitions to tapered section 40 along a transition boundary 32 of cap skirt 28 and tapered section 40.

FIG. 4 shows indentations or slots 34 along the periphery 30 of circular top wall 26. In some embodiments, horizontal indentations or evenly spaced slots 34 around a circumference of periphery 30. Slots 34 facilitate molding of cap 16 and may be used to couple cap 16 to cover 18. At the opposite end of cap 16 (e.g., a bottom), tamper band 36 couples to tapered section 40 of cap skirt 28 with frangible members 38. When closure 10 (e.g., cap 16 and cover 18) rotates off container 12, frangible members 38 break. This configuration enables visual inspection and verification of a tampered product (e.g., opened). The force coupling cap 16 to cover 18 (e.g., to form closure 10) is generally greater than the tensile force required to break frangible members 38, such that removing closure 10 from tamper band 36 does not result in separation of cap 16 from cover 18.

Cap 16 includes tapered section 40 that extends between transition boundary 32 of cap skirt 28 and frangible members 38. By way of example, tapered section 40 extends from a horizontal axis C-C at transition boundary 32 in a down and outward direction at a taper angle, a, from 75° to 15°. In various embodiments, the taper angle is between 65° and 25°, specifically between 55° and 30°, and more specifically between 50° and 40°. For example, in a specific embodiment, the taper angle is 45°.

Tamper band 36, of cap 16, includes a base 42 that is coaxial with tamper band 36. A large diameter defines base 42 relative to the diameter of tamper band 36. In this way, base 42 of tamper band 36 remains visible on closure 10 when closure 10 seals the neck 14 of container 12. A plurality of horizontal slits or grooves 44 are spaced between frangible members 38. Grooves 44 weaken the boundary between tamper band 36 and tapered section 40 to provide a designed fracture along the upper boundary of tamper band 36. In a specific embodiment, grooves 44 are evenly spaced a circumference of tamper band 36 to create frangible members 38.

FIG. 5 illustrates cover 18 of closure 10. Cover 18 has a circular top wall 46 defined by a diameter D-D that extends along a perimeter of cover 18. Diameter D-D of cover 18 is greater than diameter B-B of cap 16 so that the cover 18 fits over the cap 16 to form closure 10. A cover skirt 54 extends downwardly from a periphery 56 of circular top wall 46 of cover 18. In one embodiment, cover 18 has a plurality of alternating vertical ridges 48 between vertical indentations 50 along a circumference of outer surface 52 of cover skirt 54.

When the cover 18 is coupled to cap 16 to form closure 10, tapered section 40 enables cap 16 to fit within cover 18 while the tamper band 36 extends outward to form around or encircle engagement ring 24. This configuration enables circular top wall 26 of cap 16 to fit within circular top wall 46 of cover 18 and have the outer diameter of tamper band 36 and/or base 42 linearly align with outer surface 52 of cover 18. In some embodiments, base 42 of cap 16 aligns (e.g., is flush) with outer surface 52 of cover skirt 54 on the assembled closure 10.

In some embodiments, cover skirt 54 tapers inward from circular top wall 46 of cover 18 down to lower edge 58 of cover skirt 54. In a specific embodiment, cover skirt 54 tapers inward from circular top wall 46 of cover 18 down to lower edge 58 of cover skirt 54 at an angle, β. Angle β is defined from a horizontal axis E-E along circular top wall 46 of cover 18 to cover skirt 54 along periphery 56. In various embodiments, angle β tapers inward at an angle from 60° to 90°, specifically between 70° and 90°, and more specifically between 75° and 85°.

Figure 6:
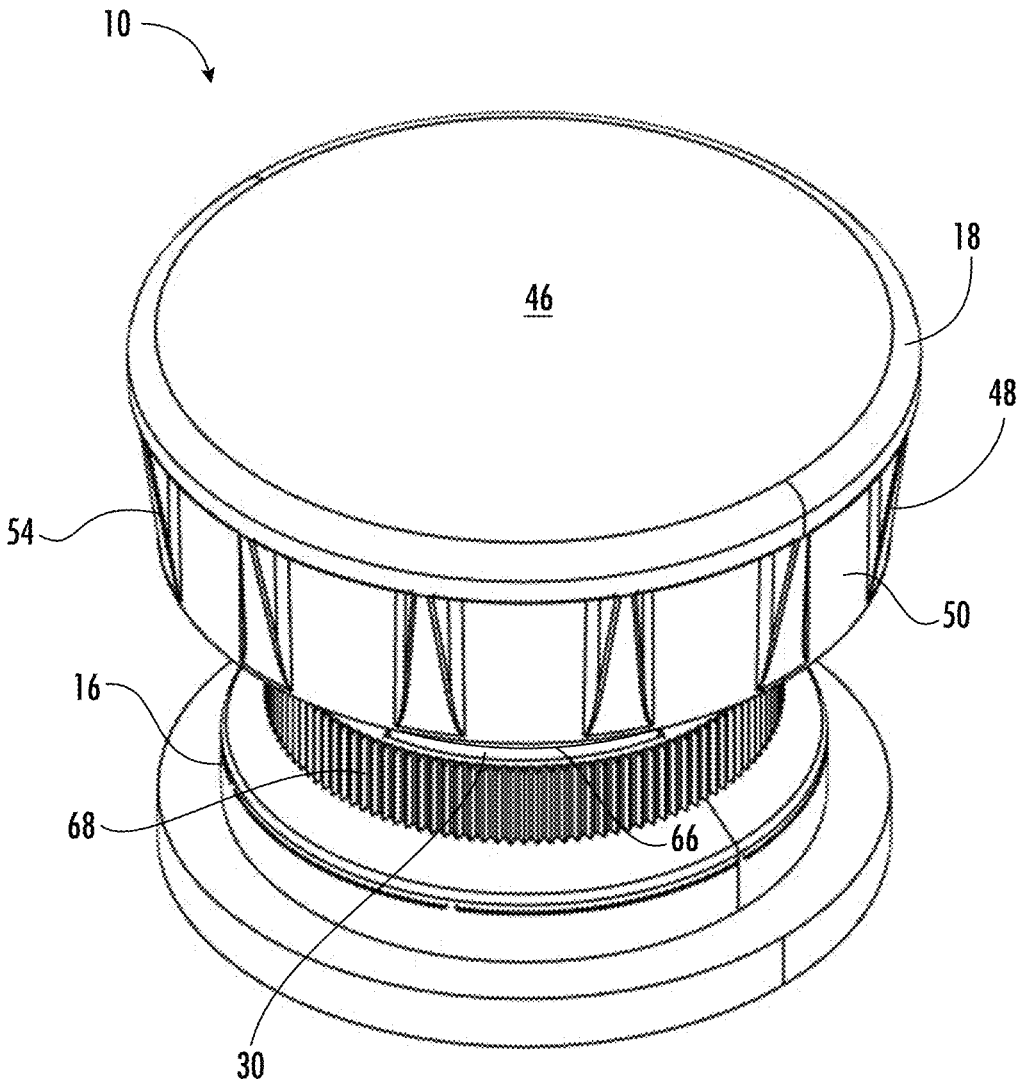
FIG. 6 is an exploded perspective view of the closure of FIG. 3, according to an exemplary embodiment.
Figure 7:
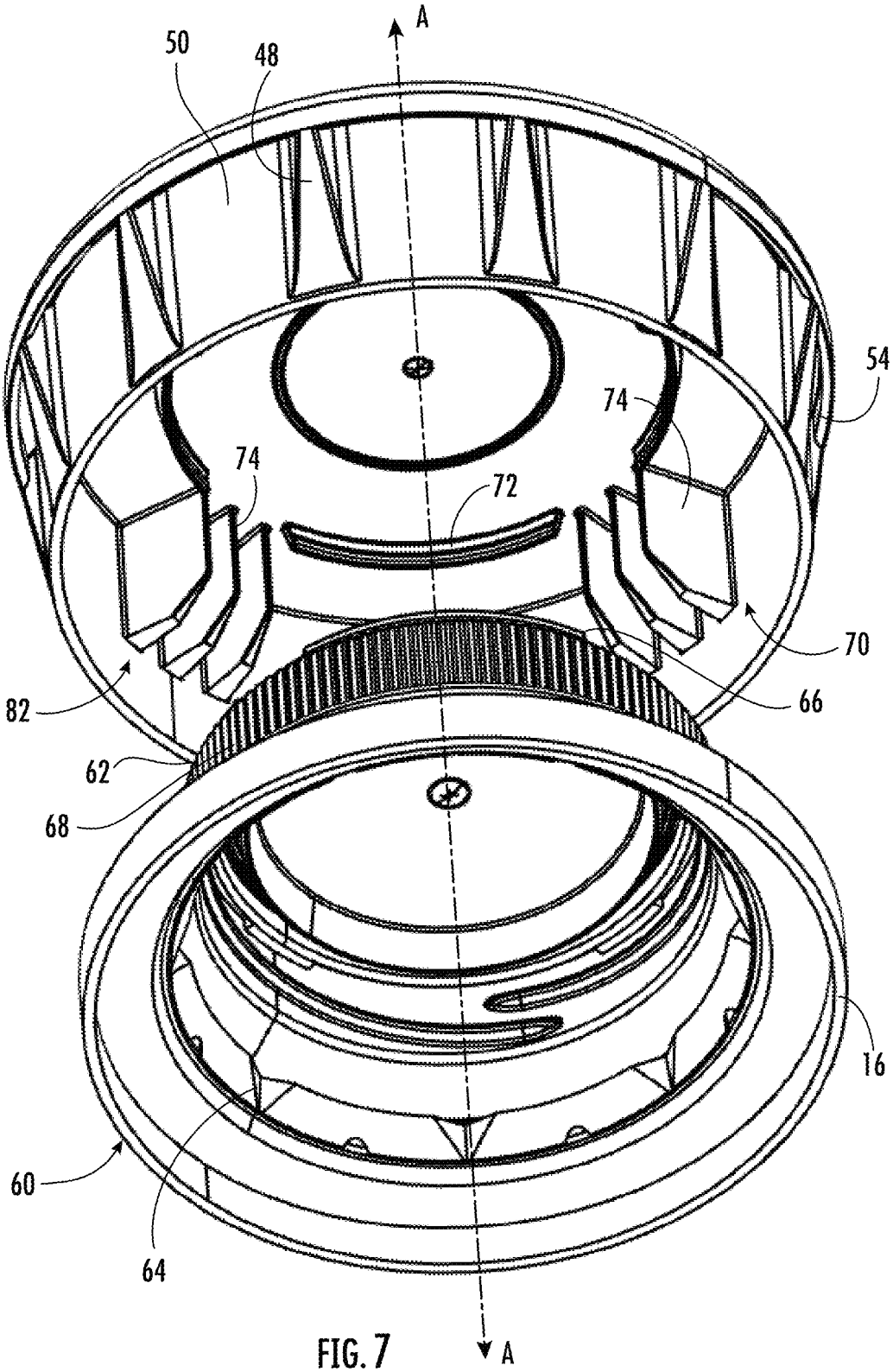
FIG. 7 is an exploded bottom perspective view of the closure of FIG. 3, according to an exemplary embodiment.

FIGS. 6 and 7 illustrate a top and bottom perspective view of an exploded closure 10, with associated cap 16 and cover 18. FIGS. 6 and 7 show that cap skirt 28 includes an inner surface 60 and an outer surface 62. Inner surface 60 of cap 16 includes a sealing formation or engagement thread 64. Outer surface 62 includes an attachment detent 66 along periphery 30 of circular top wall 26 of cap 16, and anti-rotation formations 68 formed on outer surface 62.

Anti-rotation formations 68 extend from outer surface 62 of cap 16 oriented vertically (e.g., formed perpendicular to circular top wall 26 on outer surface 62 of cap 16). Anti-rotation formations 68 are spaced around a circumference of cap skirt 28. In a specific embodiment, anti-rotation formations 68 are spaced evenly around the circumference of cap skirt 28, for instance at an angle, measured from the peaks of two surrounding anti-rotation formations 68, from 0.5° to 3° around the circumference of cap skirt 28, specifically between 1° and 2°. For example, each anti-rotation formation 68 has a width between 1 mm to 10 mm, specifically between 1 mm and 5 mm. By way of further example, each anti-rotation formation 68 is greater in length (e.g., vertically) than in width (e.g., horizontally).

Circular top wall 46 of cover 18 and cover skirt 54 define a cover interior 70. Interior 70 has an engagement formation or mating detent 72 and a plurality of fins 74 (or mating anti-rotation formations on cover 18) formed about the inner circumference of the cover 18. Cover 18 encloses at least a portion of cap 16 when mating detent 72 is engaged with attachment detent 66. Anti-rotation formations 68 of cap 16 interact with fins 74 of cover 18 to rigidly couple cap 16 to cover 18 and restrict rotation of cover 18 relative to cap 16 when closure 10 rotates. Similarly, attachment detent 66 and mating detent 72 couple to securely fasten cap 16 to cover 18 and form a rigid closure 10 that can rotate off neck 14 as a solid unitary body. The joints between detents 66 and 72 and formations 68 and fins 74 cooperate to provide a look and feel of a single closure 10. In this way, a user of the closure 10 can securely rotate closure 10 on a container 12 as though it were a single unitary piece without separating cap 16 from cover 18.

Figure 8:
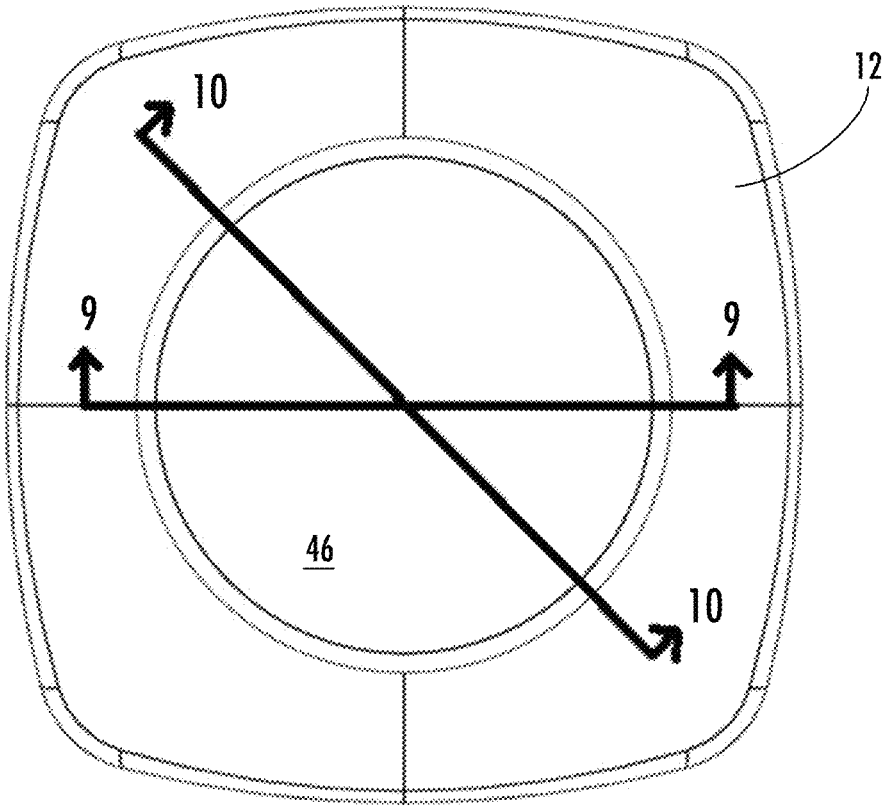
FIG. 8 is a top view of the closure on the container of FIG. 1, according to an exemplary embodiment.

FIG. 8 is a top view of closure 10 coupled to container 12. Cover 18 completely covers cap 16 when closure 10 is securely fastened and/or sealed to neck 14 of container 12. In some embodiments, cover 18 is non-uniform; e.g., it has different cross-sections at different angles. This is illustrated with the cross-sections taken along line 9-9 and 10-10. The cross-section of 9-9, shown in FIG. 9, intersects a middle fin 74 within a fin group 82. The cross-section of 10-10, shown in FIG. 10, passes in between two fin groups 82. For example, the cross-section of FIG. 9 taken through a mid-section of a fin 74 within a fin group 82, differs from the cross-section of FIG. 10, taken in between two fin groups 82.

Figure 9:
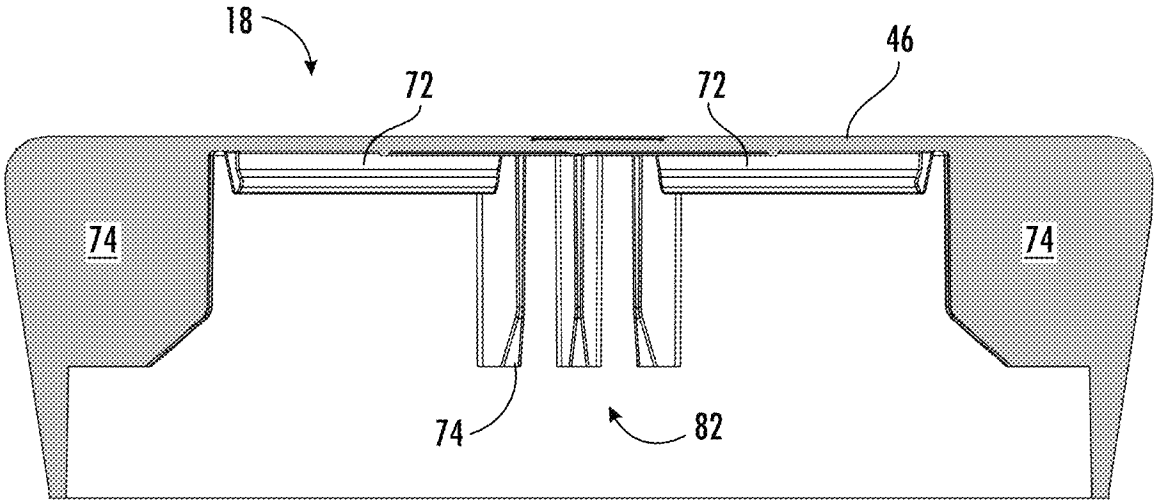
FIG. 9 is a sectional view of a cap cover of the closure taken along line 9-9 of FIG. 8, according to an exemplary embodiment.
Figure 10:
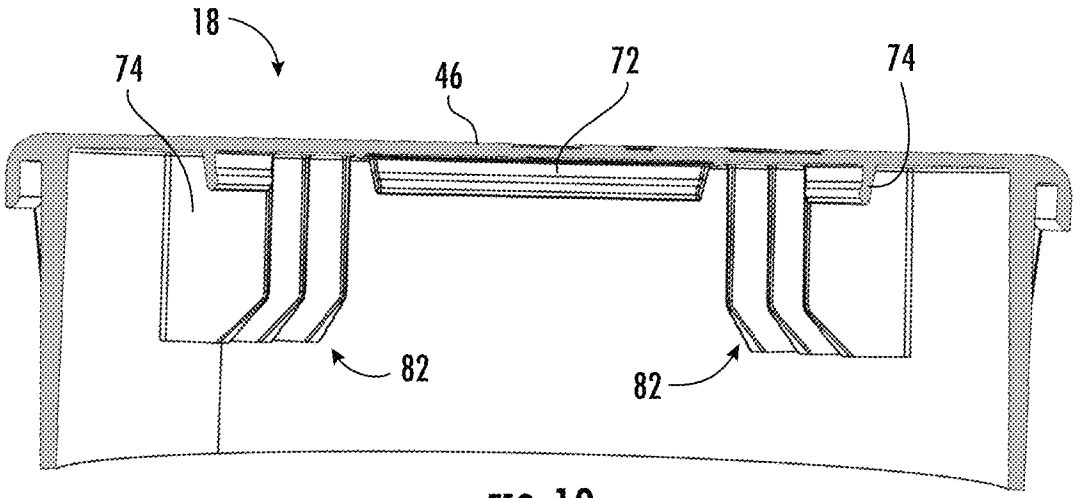
FIG. 10 is a sectional view of a cap cover of the closure taken along line 10-10 of FIG. 8, according to an exemplary embodiment.
Figure 16:
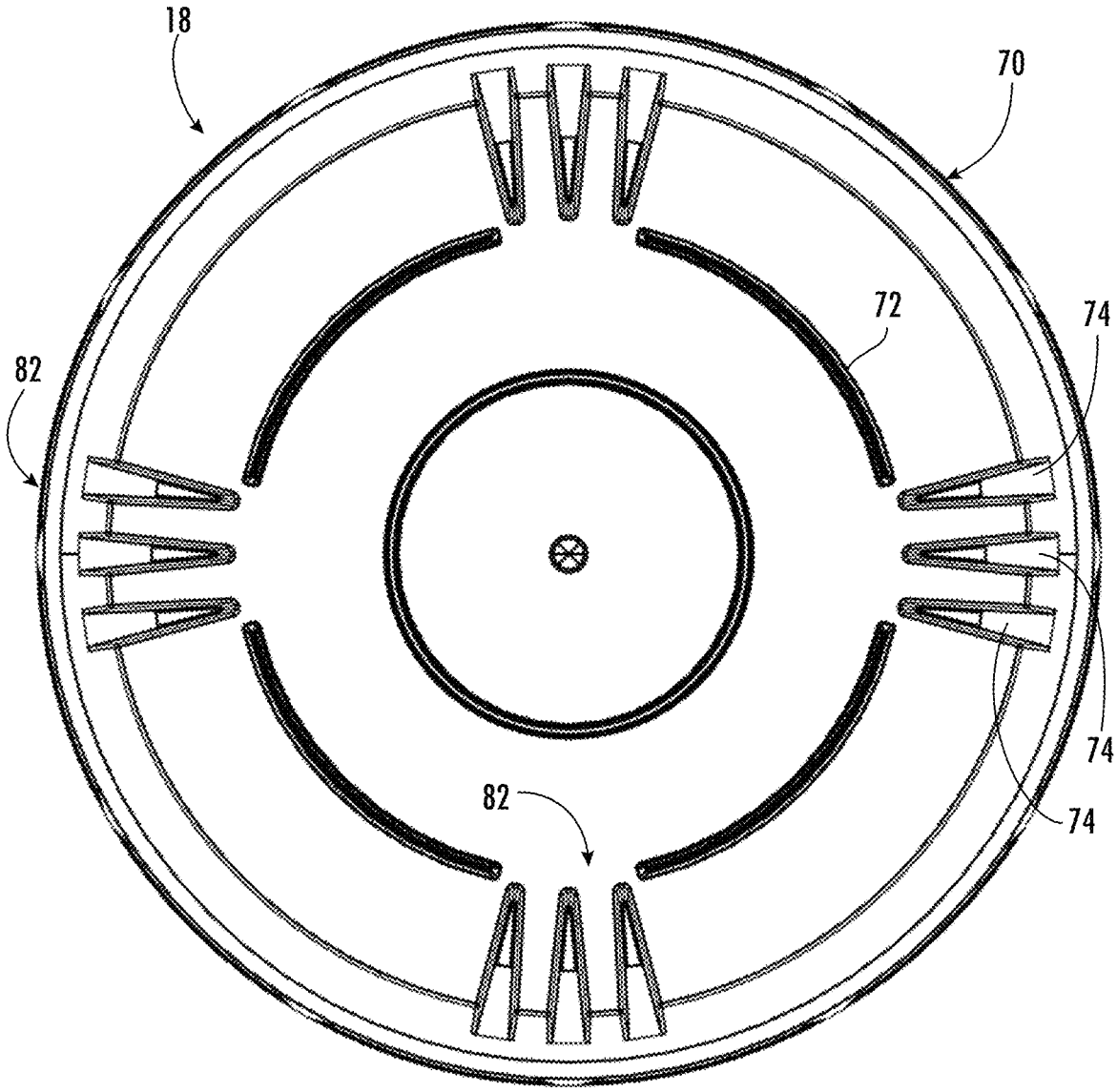
FIG. 16 is a bottom view of a cap cover of a closure, according to an exemplary embodiment.

With reference to FIGS. 9-10, a comparison of the two cross-sections taken respectively along lines 9-9 and 10-10 of FIG. 8, illustrates fin groups 82 intermittently disposed around an inner circumference of cover 18. Fins 74 are oriented vertically and form a right angle (are perpendicular) with circular top wall 46 of cover 18 and interior 70 of cover skirt 54. In some embodiments, each fin group 82 comprises at least three individual fins 74. For example, fin groups 82 each having three individual fins 74 and are spaced evenly around interior 70 of cover skirt 54. Specifically, fins groups 82 are spaced at 120° around interior 70 of cover skirt 54. Similarly, as shown in FIGS. 9, 10, and 16, four fin groups 82 are spaced in groups of three fins 74 at 90° angles. Similarly, five fin groups 82 are spaced evenly at 72°, and six fin groups are spaced evenly at 60°. In addition, different configurations of fin groups 82 can be attached to anti-rotation formations 68 of similar caps 16. For example, the same cap 16 could accommodate a variety of different covers 18 with three, four, five, or six fin groups 82 each having one, two, three, four, or more fins 74, provided the diameter B-B of the periphery 30 of cap 16 matches the inner diameter of the fins 74 on each cover 18.

Figure 11:
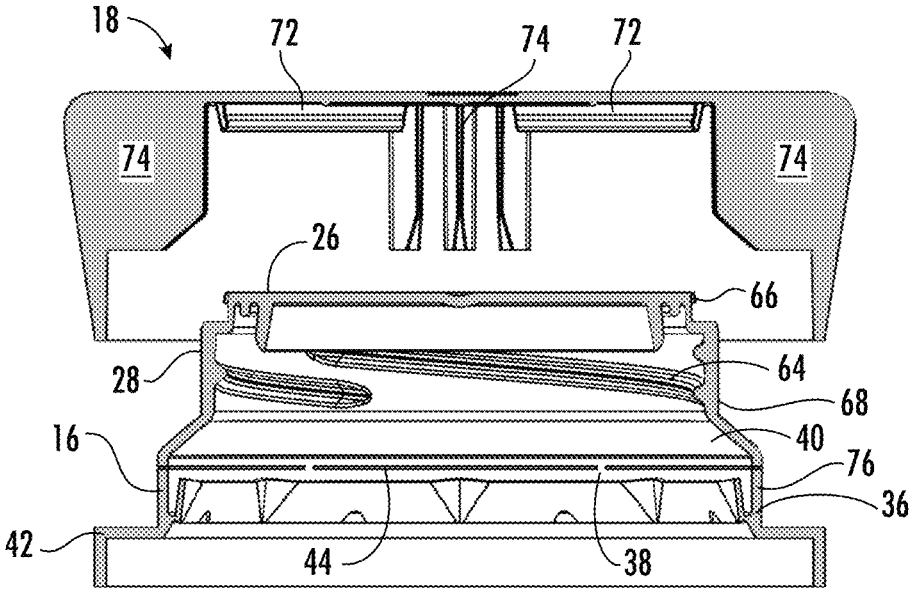
FIG. 11 is a sectional view of a cap cover inserting onto a cap of a closure, according to an exemplary embodiment.
Figure 12:
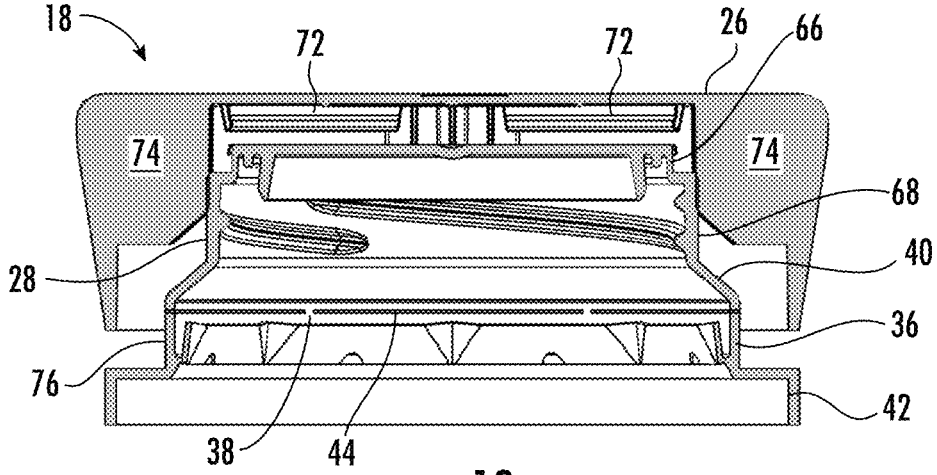
FIG. 12 is a sectional view of a cap cover further inserting into a cap of a closure, according to an exemplary embodiment.
Figure 13:
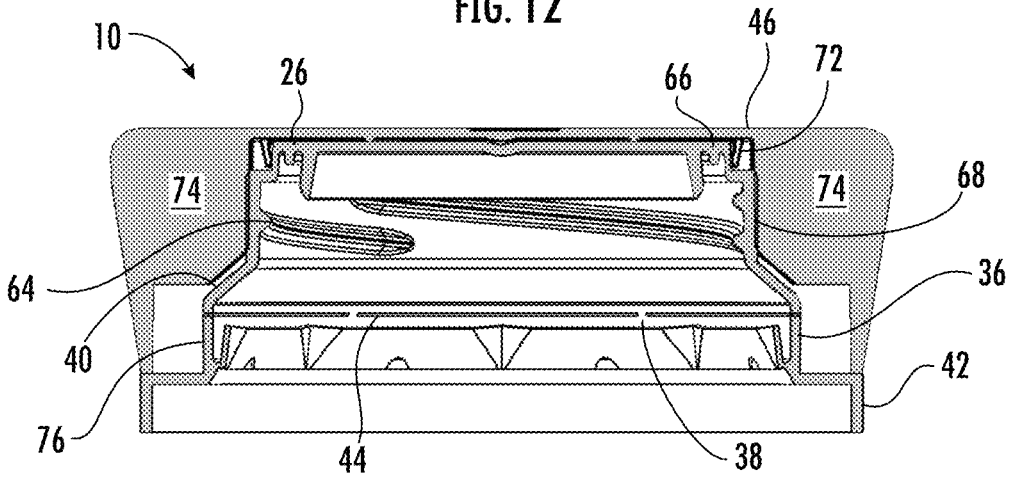
FIG. 13 is a sectional view of a cap cover on a cap of a closure, according to an exemplary embodiment.

FIGS. 11-13 illustrate the interaction of cover 18 relative to cap 16. FIG. 11 depicts cap 16 separated from cover 18. FIG. 12 illustrates the interaction of fins 74 of cover 18 with anti-rotation formations 68 of cap 16 to restrict rotation of cover 18 relative to cap 16. FIG. 13 shows the final interaction of fins 74 of cover 18 with anti-rotation formations 68 of cap 16 to form a complete closure 10. Fins 74 of cover 18 engage and fit in between anti-rotation formations 68 of cap 16 to prevent rotation of cover 18 relative to cap 16.

As shown in FIG. 11, fins 74 on cover 18 align with an outer diameter or periphery 30 of cap 16. Fins 74 include a cutout along tapered section 40 of cap 16 to enable cover 18 to fit over cap 16 at the tapered section 40. Outer wall or cover skirt 54 aligns with base 42 to for a flush and/or aligned seal where cover 18 couples to base 42 of cap 16.

Frangible members 38 within cap 16 couple to a hinge or J-band 76 that loops under engagement ring 24 to secure the tamper band 36 to the neck 14 of container 12. When closure 10 is rotated tamper band 36 is restrained by engagement ring 24 at the J-band 76 and the tensile axial force (e.g., along axis A-A) breaks the tamper band 36 along the frangible members 38 to separate the sealing portion of top wall 26 and cap skirt 28 from the tamper band 36 and base 42.

An annular sidewall 78 is included on an inner surface 60 of cap 16 to interface against neck 14 to seal aperture 20 of container 12 neck 14. An annular channel 80 that interfaces with a top of neck 14 as thread 22 and engagement thread 64 draw annular sidewall 78 of cap 16 into the internal cavity of container 12. Annular channel 80 and circular top wall 46 of closure 10 collectively form a liquid-seal around aperture 20 of neck 14 to seal contents of container 12 within an internal body of container 12.

FIG. 12 shows the cover 18 incrementally closer to cap 16. In this configuration, the fins 74 are engaged with the anti-rotation formations 68, but the attachment and mating detents 66 and 72 are still separated and unengaged. As the attachment and mating detents 66 and 72 are drawn closer together (e.g., as shown in FIG. 13) they interact to form another joint between cap 16 and cover 18.

Figure 14:
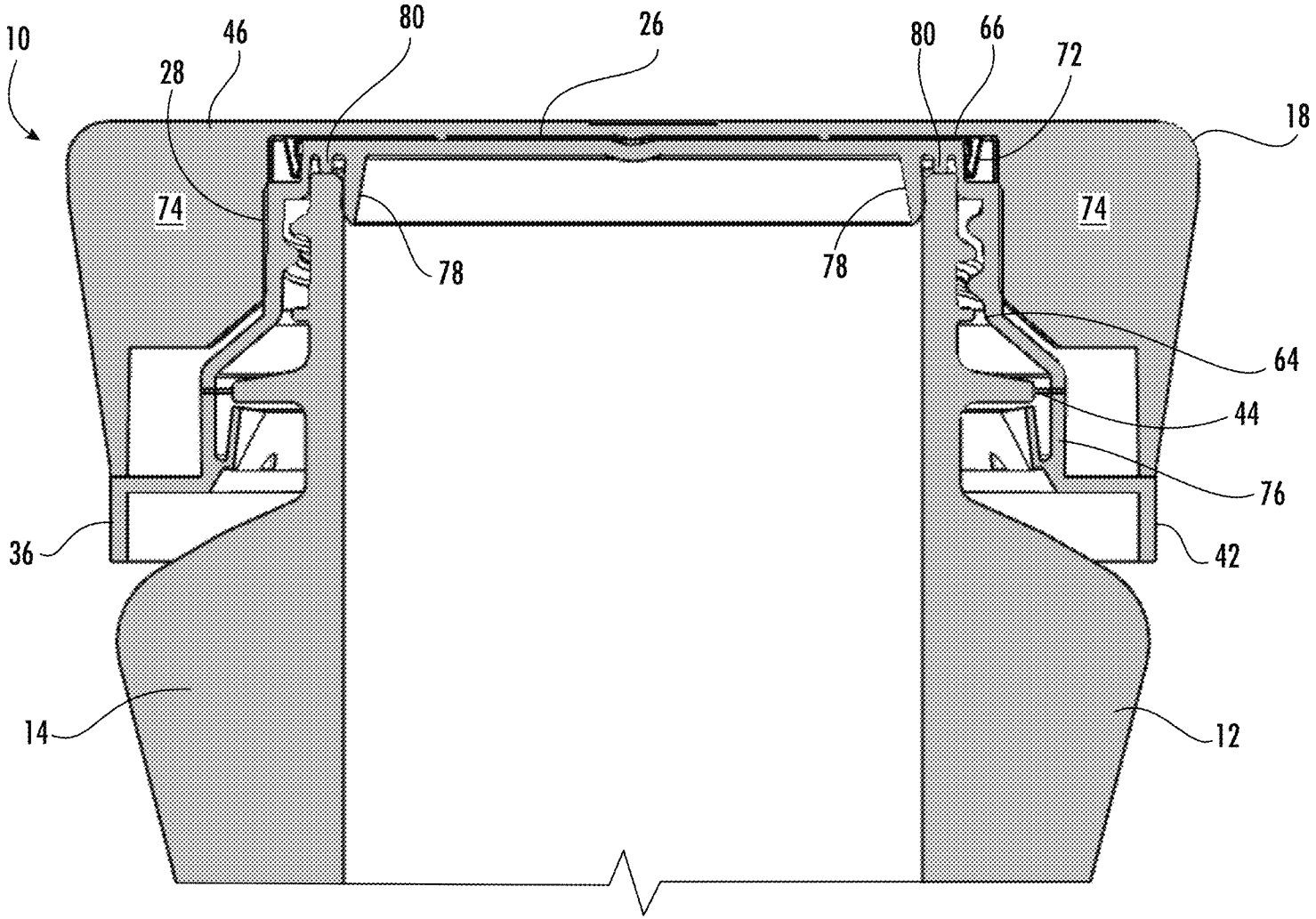
FIG. 14 is a sectional view of a closure on a container, according to an exemplary embodiment.
Figure 15:
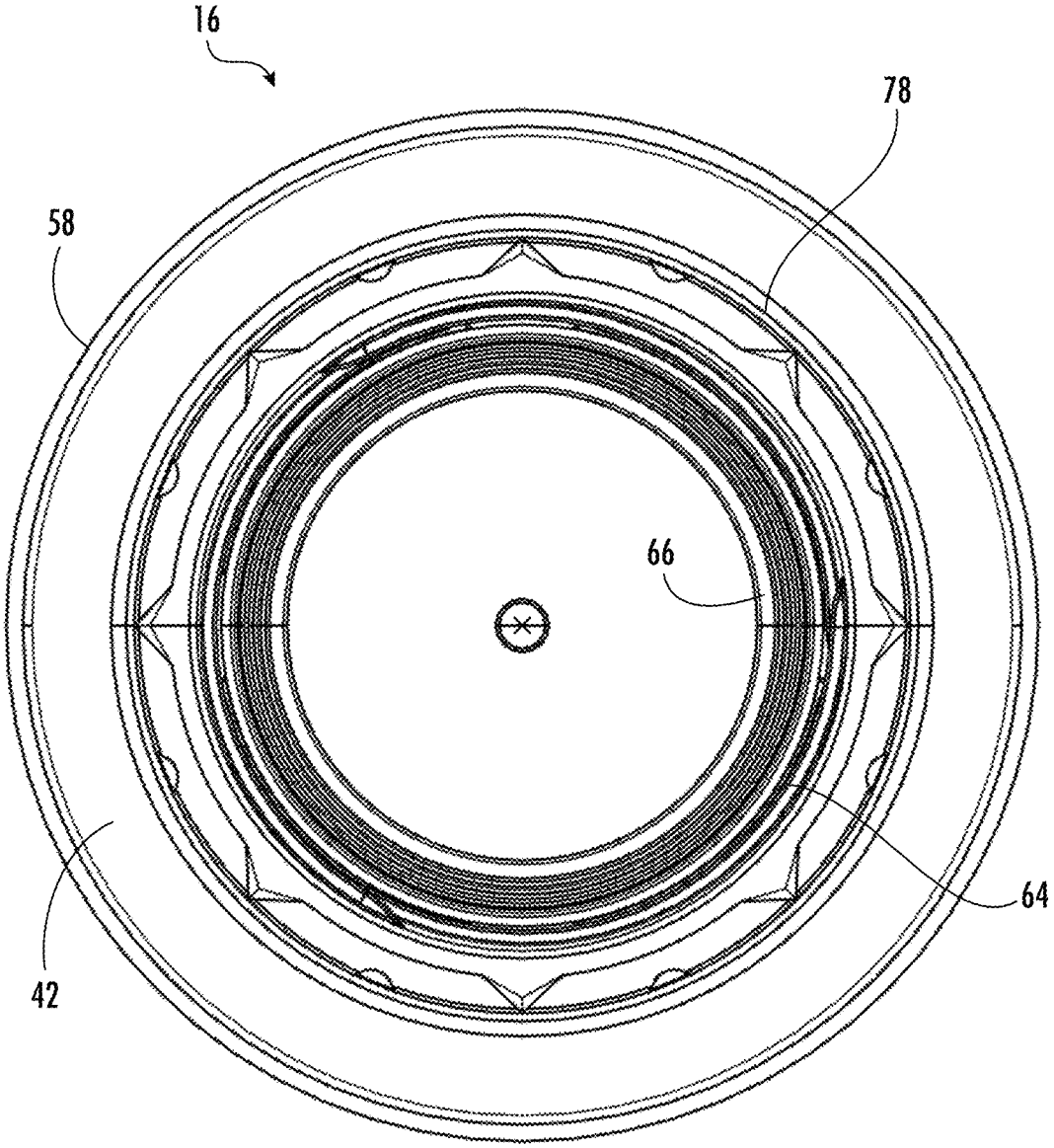
FIG. 15 is a bottom view of a closure, according to an exemplary embodiment.

As best illustrated in FIG. 14, when closure 10 is applied to neck 14 of container 12, sealing formation, or at least one engagement thread 64 of cap 16 engages mating sealing formation or at least one thread 22 of neck 14 of container 12. Tamper band 36 engages mating attachment formation or engagement ring 24 to seal container 12. FIG. 15 depicts base 42 of cap 16 being flush with lower edge 58 of cover skirt 54 when closure 10 is assembled on neck 14 of container 12, and that mating detent 72 is engaged with groove, or attachment detent 66 (not visible). When a sufficient outside force is applied to cover 18 (e.g., a hand of a user twisting cover 18), first circular top wall 26, cap skirt 28, and tapered section 40 of cap 16 are removed from neck 14 along with cover 18. Fins 74 of cover 18 stay engaged with anti-rotation formations 68 of cap 16 upon and after application of the outside force. One, some, or all of frangible members 38 are broken to separate cap skirt 28 and tapered section 40 from tamper band 36. Tamper band 36 remains engaged with mating attachment formation, or engagement ring 24.

In some embodiments, tamper band 36 includes an inner surface with at least one radially inwardly projecting retaining element. The retaining element includes at least one J-band. Each J-band 76 is attached at a lower end to inner surface 60 of tamper band 36 via a J-band hinge. An upper, free end of the J-band 76 that is defined by an engagement surface or ring 24. The retaining element includes a plurality of structures (e.g., beads, tabs, flanges) projecting radially inwards from the inner surface 60 of tamper band 36 to engage a corresponding retaining structure (e.g., mating sealing formation, or at least one thread 22) of neck 14 of container 12 to which closure 10 is attached.

In some embodiments, shown in FIG. 16, at least four fin groups 82 each comprising three fins 74 are spaced evenly every 90° around interior 70 of cover skirt 54. Similarly, three fin groups 82 of three fins 74 are spaced 120° from each other and five fin groups 82 of three fins 74 are spaced 90° from each other around interior 70 of cover skirt 54.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps, or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A 2-piece closure configured to close a container having a container neck defining an opening to the container, the closure comprising:

an axis;

a cap having a first circular top wall and a first skirt extending downwardly from a periphery of the first circular top wall to a lower edge of the first skirt, the first skirt including an inner surface having a sealing formation, an outer surface opposite the inner surface, a first detent coupled to the first circular top wall, a first formation formed on the outer surface, and a tamper band attached to the lower edge of the first skirt by a plurality of frangible members, the sealing formation configured to couple the cap to the container neck, the plurality of frangible members providing a visual indication, when broken, that the closure has been opened, the cap centered on the axis, the cap including an annular sidewall extending downward from the first circular top wall, the annular sidewall configured to interface against the container neck to seal the opening of the container neck; and a cap cover including a second circular top wall, a second skirt extending downwardly from a periphery of the second circular top wall, the second circular top wall and the second skirt defining an interior having a second detent and a second formation formed therein, the second detent configured to engage with the first detent such that the cap cover is biased from being vertically removed from the cap as a result of the engagement between the second detent and the first detent, the second formation configured to engage with the first formation of the cap such that the cap is biased from rotating relative to the cap cover in both rotational directions as a result of the engagement between the second formation and the first formation, the cap cover enclosing at least a portion of the cap when the second detent is engaged with the first detent, the cap cover centered on the axis, the cap cover including one or more mating detents extending downward from the second circular top wall, the one or more mating detents circumferentially surrounding the first circular top wall of the top wall, the one or more mating detents being radially further from the axis than the annular side wall of the cap, and the one or more mating detents located above the second formation of the cap cover.

2. The closure of claim 1, the first circular top defining a first diameter and the second circular top wall defining a second diameter larger than the first diameter.

3. The closure of claim 1, wherein each of the plurality of frangible members are broken when the closure is opened.

4. The closure of claim 1, wherein the second skirt tapers inward from the second circular top wall down to a lower edge of the second skirt, and wherein the second skirt tapers inward from the second circular top wall down to the lower edge of the second skirt at an angle from 75° to 85° relative to horizontal.

5. The closure of claim 1, wherein the first formation extends vertically along the outer surface of the cap.

6. The closure of claim 1, the cap including a plurality of indentations that extend circumferentially along the periphery of the first circular top wall of the cap.

7. The closure of claim 1, the cap including a plurality of formations formed on the outer surface, the plurality of formations including the first formation, each of the plurality of formations extending vertically along the outer surface and each of the plurality of formations configured to engage with the second formation.

8. The closure of claim 7, wherein the plurality of formations are spaced evenly around a circumference of the first skirt.

9. The closure of claim 1, wherein the second formation comprises a plurality of fins oriented vertically and spaced around the interior of the second skirt and extending radially inward from the second skirt.

10. The closure of claim 9, wherein the plurality of fins comprises at least three fins.

11. A 2-piece closure configured to close a container having a container neck portion defining an opening to the container, the closure comprising:

an axis;

a cap having a first circular top wall and a first skirt extending downwardly from a periphery of the first circular top wall to a lower edge of the first skirt, the first skirt including an inner surface having at least one engagement thread. an opposing outer surface, a first projection extending outwardly from the first circular top wall, a plurality of channels formed within the first skirt, and a tamper band concentric attached to the lower edge of the first skirt by a plurality of frangible members, the engagement thread configured to couple the cap to the container neck, the plurality of frangible members providing a visual indication, when broken, that the closure has been opened, the cap centered on the axis; and a cap cover including a second circular top wall, a second skirt extending downwardly from a periphery of the second circular top wall, the second circular top wall and the second skirt defining an interior having a second projection and a plurality of fins formed therein, the second projection and each of the plurality of fins extending inwardly from the second skirt, the second projection configured to engage with the first projection such that the cap cover is biased from being vertically removed from the cap as a result of the engagement between the second projection and the first projection, the plurality of fins configured to engage with the plurality of channels of the cap such that the cap is biased from rotating relative to the cap cover in both rotational directions as a result of the engagement between the plurality of fins and the plurality of channels, the cap cover enclosing at least a portion of the cap when the first projection of the cap is engaged with the second projection of the cap cover, the cap cover centered on the axis, the cap cover including one or more mating detents extending downward from the second circular top wall, the one or more mating detents circumferentially surrounding the first circular top wall of the top wall, the one or more mating detents being radially further from the axis than the annular side wall, and the one or more mating detents located radially closer to the axis than the plurality of fins.

12. The closure of claim 11, the first circular top defining a first diameter and the second circular top wall defining a second diameter larger than the first diameter.

13. The closure of claim 11, the cap including a plurality of indentations that extend circumferentially along the periphery of the first circular top wall of the cap.

14. The closure of claim 11, wherein the plurality of channels are spaced evenly around a circumference of the first skirt.

15. The closure of claim 11, each of the plurality of channels extending vertically along the outer surface of the cap.

16. A 2-piece closure configured to close a container having a container neck portion defining an opening to the container, the closure comprising:

an axis;

a cap having a first circular top wall and a first skirt extending downwardly from a periphery of the first circular top wall to a lower edge of the first skirt, the first skirt including an inner surface having at least one engagement thread, an opposing outer surface, a first detent coupled to the first circular top wall, a plurality of recesses defined in the outer surface, and a tamper band attached to the lower edge of the first skirt by a plurality of frangible members, the engagement thread configured to couple the cap to the container neck, the plurality of frangible members providing a visual indication, when broken, that the closure has been opened, the cap centered on the axis; and a cap cover including a second circular top wall, a second skirt extending downwardly from a periphery of the second circular top wall, the second circular top wall and the second skirt defining an interior having a second detent and a plurality of fins formed therein, the second detent configured to engage with the first detent such that the cap cover is biased from being vertically removed from the cap as a result of the engagement between the second detent and the first detent, the plurality of fins configured to engage with the plurality of recesses of the cap such that the cap is biased from rotating relative to the cap cover in both rotational directions as a result of the engagement between the plurality of fins and the plurality of recesses, the cap cover enclosing at least a portion of the cap when the first detent is engaged with the second detent, the cap cover centered on the axis, the plurality of fins comprising at least four groups of at least three fins each, the at least four groups circumferentially spaced apart from each other with respect to the axis.

17. The closure of claim 16, the first circular top defining a first diameter and the second circular top wall defining a second diameter larger than the first diameter.

18. The closure of claim 16, the cap including a plurality of indentations that extend circumferentially along the periphery of the first circular top wall of the cap.

19. The closure of claim 16, wherein the plurality of recesses are spaced evenly around a circumference of the first skirt.

20. The closure of claim 16, each of the plurality of recesses extending vertically along the outer surface of the cap.

* * * * *